US011648589B2

(12) United States Patent
Mutarelli et al.

(10) Patent No.: US 11,648,589 B2
(45) Date of Patent: May 16, 2023

(54) SYSTEMS AND METHODS TO ENHANCE THE UTILIZATION OF ORDER SORTATION SYSTEMS

(71) Applicant: Target Brands, Inc., Minneapolis, MN (US)

(72) Inventors: Gervasio Mutarelli, Minneapolis, MN (US); Justin Feider, Minneapolis, MN (US); Taylor Marsh, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 128 days.

(21) Appl. No.: 17/395,045

(22) Filed: Aug. 5, 2021

(65) Prior Publication Data

US 2022/0126325 A1 Apr. 28, 2022

Related U.S. Application Data

(60) Provisional application No. 63/105,663, filed on Oct. 26, 2020.

(51) Int. Cl.

| | |
|---|---|
| ***B07C 3/08*** | (2006.01) |
| ***B07C 3/00*** | (2006.01) |
| ***B07C 3/18*** | (2006.01) |

(52) U.S. Cl.

CPC ..... *B07C 3/085* (2013.01); *B07C 3/008* (2013.01); *B07C 3/18* (2013.01); *B07C 2501/0063* (2013.01)

(58) Field of Classification Search

CPC ..... B07C 3/085; B07C 3/008; B07C 3/18; B07C 3/08; B07C 5/02; B65G 47/248

See application file for complete search history.

(56) References Cited

U.S. PATENT DOCUMENTS

| | | | | |
|---|---|---|---|---|
| 3,964,624 | A * | 6/1976 | Werder | B65G 65/23 414/421 |
| 6,722,841 | B2 * | 4/2004 | Haas | B66F 9/18 414/421 |
| 9,192,965 | B2 * | 11/2015 | Serjeantson | B07C 3/06 |
| 10,315,859 | B1 * | 6/2019 | Zhao | B65G 43/08 |
| 11,104,527 | B1 * | 8/2021 | Zhao | B65G 47/905 |
| 11,365,068 | B2 * | 6/2022 | Wertenberger | B25J 9/1697 |
| 2008/0199289 | A1 * | 8/2008 | Schafer | B65G 65/23 414/404 |

(Continued)

OTHER PUBLICATIONS

Michael Reimer [online], "Tote Dumping & Washing," uploaded Feb. 6, 2014, retrieved on Aug. 4, 2021, <https://www.youtube.com/watch?v=T5LBVrSV7Ec>, 1 page [Video Submission].

(Continued)

*Primary Examiner* — Patrick H Mackey

(74) *Attorney, Agent, or Firm* — Fish & Richardson P.C.

(57) ABSTRACT

Systems and methods can enhance efficiencies of order fulfillment processes. For example, this document describes systems and methods for optimizing the efficiency of automated order sortation processing lines to expedite order processing in a cost-effective manner. In some embodiments, this innovation includes a fast, efficient method for supplying items to order sortation process lines so that they operate at peak efficiently, and the workers are utilized at a high level of efficiency.

20 Claims, 9 Drawing Sheets

(56) References Cited

U.S. PATENT DOCUMENTS

2015/0151913 A1 6/2015 Wong et al.

OTHER PUBLICATIONS

[Jogvan] [online], Box tilting machine, uploaded Jun. 17, 2012, retrieved on Aug. 4, 2021, <https://www.youtube.com/watch?v=eeqFdYF2p3I>, 1 page [Video Submission].

Weening Brothers Manufacturing [online], "Standard Bin Dumper by Weening Brothers MFG," uploaded Mar. 9, 2015, retrieved on Aug. 4, 2021, <https://www.youtube.com/watch?v=GKeI7FkS_qs>, 1 page [Video Submission].

* cited by examiner

SYSTEMS AND METHODS TO ENHANCE THE UTILIZATION OF ORDER SORTATION SYSTEMS

CROSS-REFERENCE TO RELATED APPLICATIONS

This application claims the benefit of U.S. Provisional Application Ser. No. 63/105,663, filed Oct. 26, 2020. The disclosure of the prior application is considered part of (and is incorporated by reference in) the disclosure of this application.

TECHNICAL FIELD

This document relates to systems and methods for enhancing efficiencies of order fulfillment processes. For example, this document relates to systems and methods for optimizing the efficiency of order sortation process lines to expedite order processing in a cost-effective manner.

BACKGROUND

Customers expect their orders to be fulfilled properly and promptly on a consistent basis. Second-day deliveries are now essentially an ordinary expectation, and same-day or next-day deliveries are becoming more standard. Highly efficient warehousing, order processing, and shipping processes are required to meet these increasingly higher levels of customer expectations.

The order fulfillment process refers to all the steps companies take from when they receive a customer order (which can include an order that is wholly or partly internal to the company, such as a store replenishment order) until the items are landed in customers' hands. Such steps can include, for example: the orders are sent to the warehouse; a worker goes into the warehouse, finds the items in the orders, and picks the items off the shelf; items are sorted into groupings in accordance with the orders (either manually or automatically); the orders are packed for shipping; the orders are shipped. Broadly speaking, order processing involves picking (e.g., retrieval of items from where they are stored), order sortation, and packaging (e.g., getting the order ready to ship).

The use of automated order sortation processes is one way to increase the efficiency of an order fulfillment process. The goal of order processing optimization is to cut out inefficiencies of the order fulfillment process.

SUMMARY

This document describes systems and methods for enhancing efficiencies of order fulfillment processes. For example, this document describes systems and methods for optimizing the efficiency of order sortation process lines to expedite order processing in a cost-effective manner. In some embodiments, this innovation includes a fast, efficient method for supplying items to automated order sortation process lines so that the automated order sortation process lines operate at peak efficiently and the workers are utilized at a high level.

In one aspect, this disclosure is directed to an order sortation system. Such an order sortation system can include an automated item sorter configured to separate items into groups in accordance with orders for the items, an item conveyor system arranged to transport the items to an input of the automated item sorter, a barcode scanner positioned along the item conveyor system and configured to obtain scans of barcodes of the items being transported on the item conveyor system, and a container handling system. The container handling system can include a mechanism to invert a container holding the items to transfer the items onto the item conveyor system so that the item conveyor system can transport the items past the barcode scanner and to the input of the automated item sorter.

Such an order sortation system can optionally include one or more of the following features. The mechanism of the container handling system can be configured to grasp the container on a total of two sides of the container. The mechanism of the container handling system can be configured to grasp the container on a total of three sides of the container. The mechanism of the container handling system can be configured to grasp the container on all four sides of the container. In some examples, the container is a tote. The container handling system may include a robotic manipulator. The item conveyor system may include a 90 degree corner conveyor portion. The system can also include an incoming container conveyor configured to transport the container holding the items to an input of the container handling system. The system can also include an outgoing container conveyor configured to transport the container away from the container handling system after the container has been inverted by the container handling system. In some embodiments, the mechanism of the container handling system includes an arm that pivots to clamp the container against one or more other clamping surfaces of the mechanism.

In another aspect, this disclosure is directed to a method of sorting items. Such a method can include: (a) inverting, by a container handling system, a container holding items to transfer the items onto an item conveyor system; (b) transporting, by the item conveyor system, the items to an input of an automated item sorter; and (c) sorting, by the automated item sorter, the items into groups in accordance with orders for the items.

Such a method of sorting items may optionally include one or more of the following features. The method may also include obtaining, by a barcode scanner positioned along the item conveyor system, scans of barcodes of the items being transported on the item conveyor system. The method may also include grasping, by the container handling system, the container holding the items prior to inverting the container. In some cases, the grasping comprises clamping the container on a total of two sides of the container. In some cases, the grasping comprises clamping the container on a total of three sides of the container. In some cases, the grasping comprises clamping the container on all four sides of the container. The method may also include transporting, on an incoming container conveyor, the container holding the items to the container handling system. The method may also include transporting, on an outgoing container conveyor, the container away from the container handling system after the container has been inverted by the container handling system. The method may also include sliding, by the container handling system, the container holding the items across the incoming container conveyor and onto the outgoing container conveyor. In some embodiments, the transporting the items to the input of the automated item sorter includes transporting the items along a 90 degree turn in the item conveyor system.

The systems and processes described here may be used to provide one or more of the following optional benefits. First, some embodiments provide an order fulfillment process that is more efficient, responsive, and agile so orders can be shipped to internal and external customers in a shorter timeframe than some current processes. Such a result can be accomplished, for example, through optimizing the pace of material flow to automated order sortation processes, thereby reducing bottlenecks, delays and interferences. Second, in some embodiments the labor costs associated with the order fulfillment processes can be reduced using the systems and processes described herein. Third, the systems and methods described herein can result in efficiency enhancements of order sortation equipment by reducing the potential for downtime or idle time due to material flow delays.

Other features, aspects and potential advantages will be apparent from the accompanying description and figures.

DESCRIPTION OF DRAWINGS

Like reference symbols in the various drawings indicate like elements

DETAILED DESCRIPTION

This document describes systems and methods for enhancing efficiencies of order fulfillment processes. For example, this document describes systems and methods for optimizing the efficiency of automated order sortation processing lines to expedite order processing in a cost-effective manner. In some embodiments, this innovation includes a fast, efficient method for supplying items to order sortation process lines so that they operate at peak efficiently, and the workers are utilized at a high level of efficiency.

Figure 1:
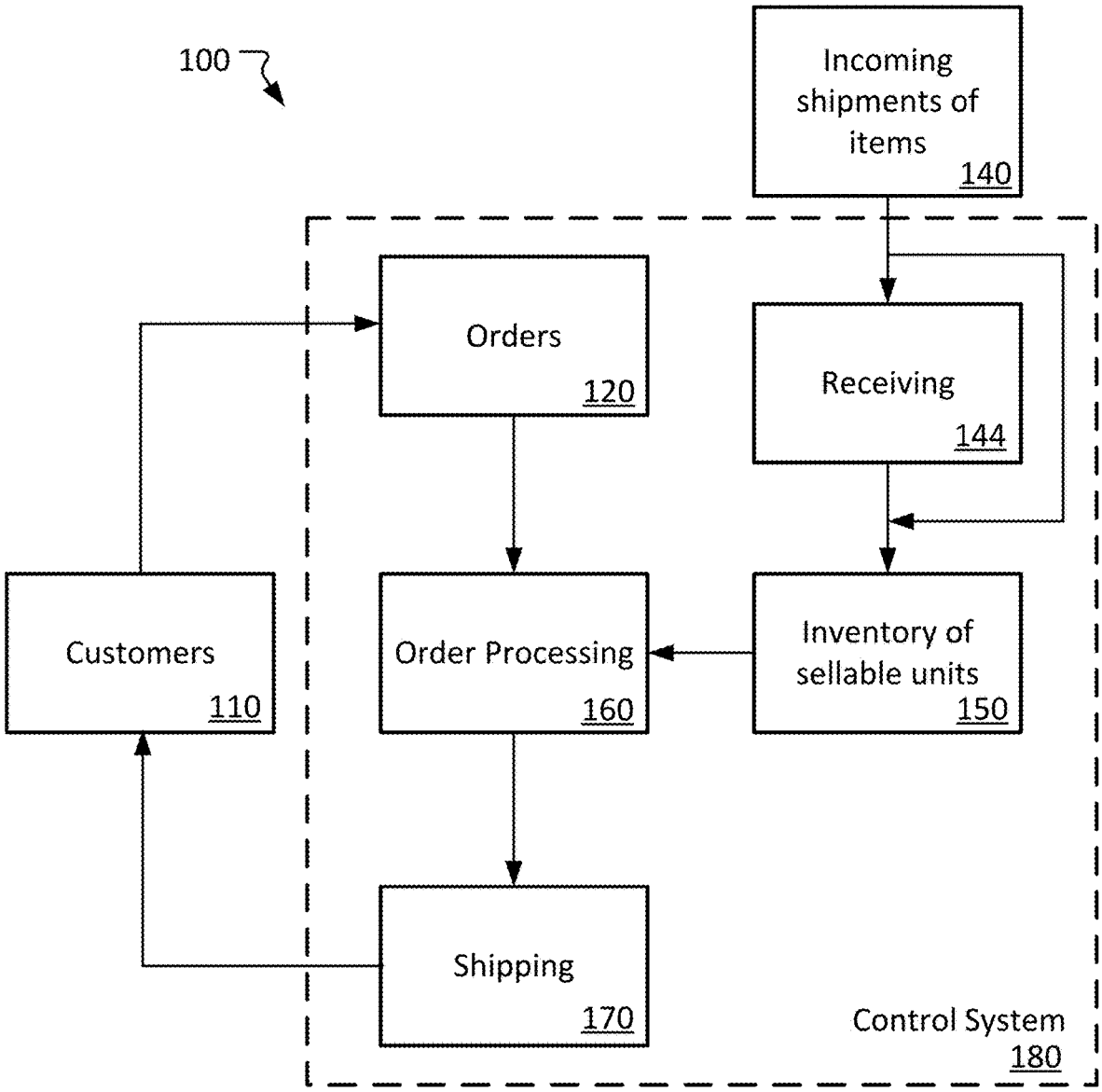
FIG. 1 is a highly simplified schematic diagram of a basic order fulfillment process.

FIG. 1 is a schematic diagram illustrating an example order fulfillment process 100. The order fulfillment process 100 may take place at a variety of different types of facilities such as, but not limited to, flow centers, distribution centers, warehouses, inventory storing locations, order fulfillment centers, receive centers, stores, cross-docking facilities, material handling facilities, and the like, and combinations thereof. In this disclosure, the term "warehouse" may be used to refer to any and all such different types of facilities, and combinations thereof. In some examples, the order fulfillment process 100 takes place at a single facility. Alternatively, in some examples execution of the order fulfillment process 100 is distributed across two or more facilities. A warehouse as described herein can be a portion of a multi-echelon supply chain.

Order fulfillment process 100 includes the daily replenishment and movement of inventory generated from real-time demand singles for in-store retail sales and direct-to-guest on-line sales fulfilled from a multi-echelon inventory-holding model at the correct unit of measure, using fast and easy material handling equipment that will create operational efficiency at every process step in the supply chain.

The flow of sellable items within the overall order fulfillment process 100 is driven by demand for those sellable items from customers 110. In this disclosure, the term "customers" will be used to broadly refer to a variety of different entities such as, but not limited to, individual consumers, retail stores (e.g., for stock replenishment), business partners, other warehouses, and the like.

Tangible orders 120 result from the demand for sellable items from the customers 110. An individual order 120 may be for one unit of a single sellable item, for multiple units of a single sellable item, for two or more different types of sellable items, for a case quantity, for a pallet load, and the like, and any and all possible permutations thereof. Whatever the order 120 includes, the goal of the order fulfillment process 100 is to ship (preferably in a single shipment) all of the sellable items included in the orders 120 in a timely and accurate manner, while incurring the lowest costs possible. However, the scope of the order fulfillment process 100 also includes partial shipments that do not include all of the items included in an order 120.

The orders 120 are entered into a control system 180 (represented in FIG. 1 by the dashed-line boundary). In some examples, the control system 180 may be part of and/or may comprise a business management system such as, but not limited to, an enterprise resource planning (ERP) system, a materials management system, an inventory management system, a warehouse management system, one or more automation control systems, and the like, and combinations thereof. Accordingly, the control system 180 can, in some cases, broadly encompass multiple systems that can be situated locally, remotely, or situated both locally and remotely. The control system 180 can include hardware, software, user-interfaces, and so on. For example, the control system 180 may include one or more computer systems, data storage devices, wired and/or wireless networks, control system software (e.g., programs, modules, drivers, etc.), user interfaces, scanners, communication modules, interfaces for control communications with robots, and the like. Such scanners may include hand-held, mobile, and/or fixed readers that can scan, receive, or otherwise detect marks or tags (e.g., bar codes, radio frequency identification (RFID) tags, etc.) on individual sellable items or collections of sellable items (e.g., cases and totes) and communicate with a control station or stations of the control system 180. The scanners may also be able to scan, receive, or otherwise detect the marks or tags (e.g., bar codes, RFID tags, etc.) attached to or integrated with conveyance receptacles such as inventory totes and boxes.

Still referring to FIG. 1, incoming shipments of items 140 arrive at the warehouse. In some cases, the incoming shipments of items 140 are processed by receiving 144 (e.g., the performance of inspections, quantity confirmations/reconciliations, inventory/order control system transactions, etc.). Afterwards, the items enter into inventory 150 of the warehouse as sellable units. In some cases, some incoming items go directly from receiving 144 into inventory 150 (e.g., if the incoming items were transferred in from an affiliated facility at which the items were already in the inventory system). The types and quantities of the incoming items 140 may be controlled to keep a desired stock level of the sellable units in the inventory 150 of the warehouse. In some cases, the types and quantities of the incoming items 140 may be the result of a proactive inventory transfer (e.g., "pushing" inventory), a reactive inventory transfer (e.g., "pulling" inventory), and/or other such inventory management techniques.

The sellable units in inventory 150 can be located in various types of storage accommodations such as racks, shelves, containers, vessels, carts, bins, totes, pallet lanes, ASRS (automated storage and retrieval system), and the like. Such storage accommodations can be individually identified and tracked by the control system 180. That is, the control system 180 can be used to keep track of the quantities in stock of the various sellable items in the inventory 150 and of the inventory location(s) of the various sellable items in the inventory 150. The sellable items in the inventory 150 can be stored in various receptacles such as, but not limited to, boxes, totes, pallets, baskets, bins, bags, and the like.

Next, in the step of order processing 160, the sellable item(s) included in the customer order 120 are compiled in preparation for shipment to the respective customer 110. This step includes order sortation processes as described below in the context of FIGS. 2-9.

To fulfill the customer orders 120, the one or more items specified in each order may be retrieved, or picked, from inventory 150. As described further below, the sellable items pertaining to the individual customer orders 120 may be delivered or conveyed to one or more areas in the warehouse for sorting (order sortation) and compiling into one or more outbound shipping containers for the fulfillment of the respective customer orders 120. Outbound shipping containers containing the ordered sellable items are then transported to customers 110 at the step of shipping 170.

FIG. 1 and the foregoing description of the order fulfillment process 100 has provided a high-level overview of the operations of a warehouse. Next, in reference to FIGS. 2-9, a more detailed description focused particularly on the operations of an order sortation system (which is part of order processing 160) will be provided.

Figure 2:
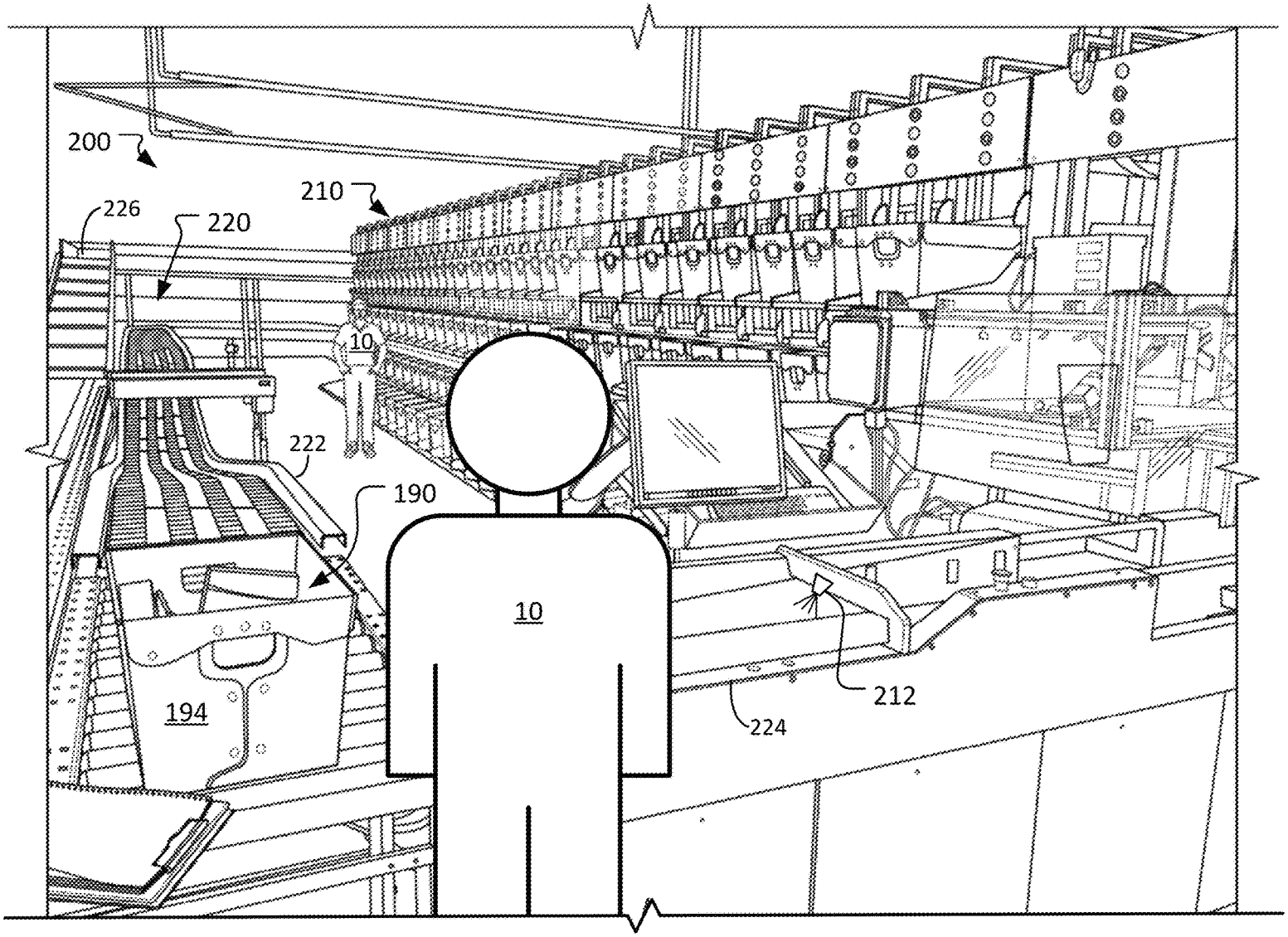
FIG. 2 is a depiction of an example order sortation system in accordance with some embodiments.
Figure 3:
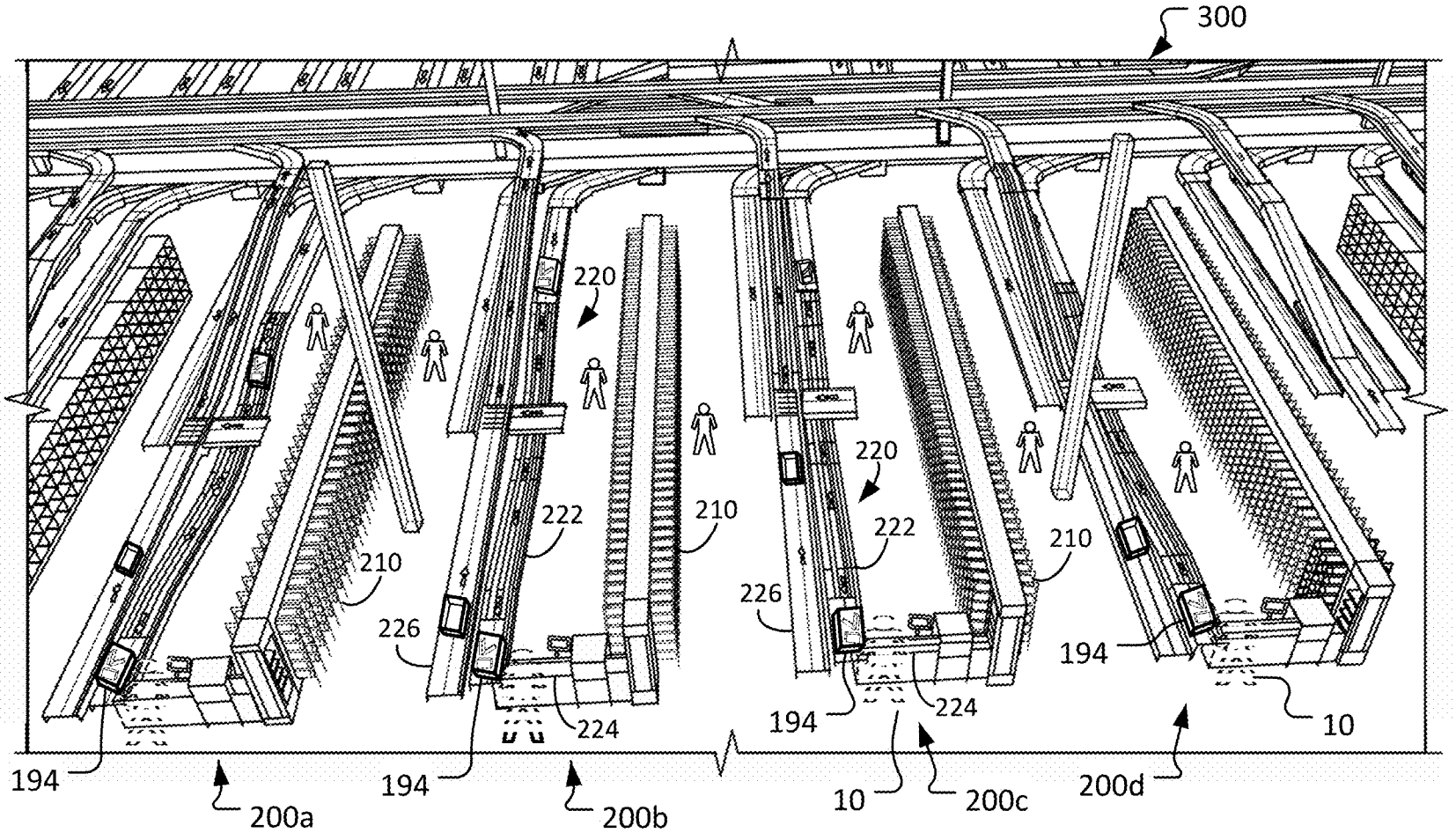
FIG. 3 illustrates a warehouse with multiple parallel order sortation systems like the order sortation system of FIG. 2.

FIGS. 2 and 3 illustrate example automatic order sortation systems 200. The purpose of the order sortation system 200 is to efficiently sort a large quantity of a variety of different types of unsorted items 190 into the proper combinations and quantities of items to fulfill multiple individual orders. FIG. 2 illustrates a single order sortation system 200. FIG. 3 illustrates multiple order sortation systems 200 in a warehouse.

Each order sortation system 200 broadly includes an automated item sorter 210 and an item conveyor system 220. The item conveyor system 220 includes an incoming conveyor 222, an induction conveyor 224, and an outgoing conveyor 226.

Incoming unsorted items 190 can be transported from an inventory storage location, decantation station, or other type of upstream operation to the automated item sorter 210 via the incoming conveyor 222 and/or using various other types of material handling systems (e.g., mobile robots, AGVs, etc.). The unsorted items 190 can be contained within a container 194 such as a tote, bin, tray, box, and the like. In some cases, the container 194 may have only a single item 190 in it. In most cases, the containers 194 will have multiple items 190 therein. Optionally, the worker 10 may scan a barcode on the container 194, or a barcode scanner along the incoming conveyor 222 may scan a barcode on the container 194.

The incoming unsorted items 190 can be individually inducted into the automated item sorter 210 by a worker 10 via the induction conveyor 224. That is, the worker 10 can reach into the container 194, grasp an individual item 190 within the container 194, and then place the individual item 190 onto the induction conveyor 224. The worker 10 will repeat this process, on an individual item 190 by item 190 basis, until the container 194 is completely empty of items 190. Then the empty container 194 can be transferred to the outgoing conveyor 226 to return the empty container 194 to the upstream process so that the empty container 194 can be reused.

It should be noted that the worker 10 can transfer the individual items 190 from the container 194 to the induction conveyor 224 at only a moderate pace. In fact, in many instances the pace at which the worker 10 can transfer the individual items 190 from the container 194 to the induction conveyor 224 is the throughput constraint or "bottleneck" of the overall order sortation system 200. That is, the automated item sorter 210 could sort items 190 at a much faster pace if only the individual items 190 were inducted/fed to the automated item sorter 210 at such a faster pace. Said another way, the automated item sorter 210 is underutilized because of the relatively slow-paced manual item induction process that requires the worker 10 to reach into the container 194, grasp an individual item 190 within the container 194, and then place the individual item 190 onto the induction conveyor 224.

Improved item induction processes are described below in reference to FIGS. 4-9. Such improved item induction processes can induct items 190 to the automated item sorter 210 at a faster pace than the manual item induction process that requires the worker 10 to reach into the container 194, grasp an individual item 190 within the container 194, and then place the individual item 190 onto the induction conveyor 224.

As the individual items 190 are being transported to the automated item sorter 210 via the induction conveyor 224, a barcode scanner 212 positioned along the induction conveyor 224 scans the barcode on each of the items 190 to determine the identity of each of the unsorted items 190 individually. This identification can be performed using the bar code scanner 212 or by other techniques (a RFID reader, visually, etc.). From there, the automated item sorter 210 can perform the task of automatically sorting the inducted items 190 into the proper combinations of items 190 to fulfill the individual orders being processed, resulting in completed individual orders contained in respective individual receptacles in a matrix of receptacle stations of the automated item sorter 210.

For example, a first order being processed by the order sortation system 200 may be for a quantity of two of item A and one of item B. A second order being processed by the order sortation system 200 may be for a quantity of four of item B and two of item C. A third order being processed by the order sortation system 200 may be for a quantity of two of item A, one of item B, and one of item C. In total then, the three orders require four of item A, six of item B, and three of item C. Accordingly, in this example the unsorted items 190 would include, at least, four of item A, six of item B, and three of item C. After the induction of the unsorted items 190 into the automated item sorter 210 on an individual item-by-item basis via the induction conveyor 224, the automated item sorter 210 will singularly automatically transport all of the items for the first order to a first receptacle in the matrix of receptacle stations, singularly automatically transport all of the items for the second order to a second receptacle in the matrix of receptacle stations, and singularly automatically transport all of the items for the third order to a third receptacle in the matrix of receptacle stations. Accordingly, when the automated item sorter 210 is finished sorting the three orders, the first receptacle will contain two of item A and one of item B (as per the first order), the second receptacle will contain four of item B and two of item C (as per the second order), and the third receptacle will contain two of item A, one of item B, and one of item C (as per the third order).

When the sortation of an individual order has been completed (such that a receptacle contains all of the items for the individual order) the automated item sorter 210 will notify a worker 10 attending to the matrix of receptacle stations so that the worker 10 can move the ordered items from the receptacle to a next operation (e.g., to a packaging operation in preparation for shipping the order). In some cases, the order sortation system 200 will utilize signal lights 222 to notify the worker 10 when a receptacle contains all of the items for the individual order. In response, in some cases the worker 10 will simply remove the receptacle containing the items from the matrix of receptacle stations and then transfer the items from the receptacle to a box for shipment. The order 10 can then replace the receptacle back into an open receptacle station of the matrix of receptacle stations.

FIG. 3 shows an example warehouse operation 300 that includes multiple (four in this example) order sortation systems 200*a*, 200*b*, 200*c*, and 200*d* arranged to operate in parallel with each other. In some embodiments, each of the depicted order sortation systems 200*a-d* can be the same as, or essentially similar to, the automated order sortation system 200 described above. In other words, the four order sortation systems 200*a-d* depicted in FIG. 3 can be four of the automated order sortation systems 200 arranged in parallel. In some embodiments, other types of order sortation systems (and combinations of different types of systems) can be used without departing from the innovative aspects for operating the multiple order sortation systems as described herein.

While four order sortation systems 200*a-d* are depicted, it should be understood that the innovative aspects described herein can be applied to order sortation processes that include any number of order sortation systems, such as one, two, three, four, five, six, seven, eight, nine, ten, eleven, twelve, and more than twelve.

A control system can control the conveyor systems 220 to transport item containers 194 for sortation to any particular one of the order sortation systems 200*a-d*. In some embodiments, the control system uses a configurable strategic scheme for determining which of the order sortation systems 200*a-d* that particular items 190 should be transported to. In other words, a configurable strategic scheme can be used for loading/utilizing the capacity of the order sortation systems 200*a-d*. The strategic schemes can cause the order sortation processes 200*a-d* to operate so as to optimize the efficiency of the order sortation processes 200*a-d* by, for example, highly utilizing human labor and minimizing material flow delays.

Figure 4:
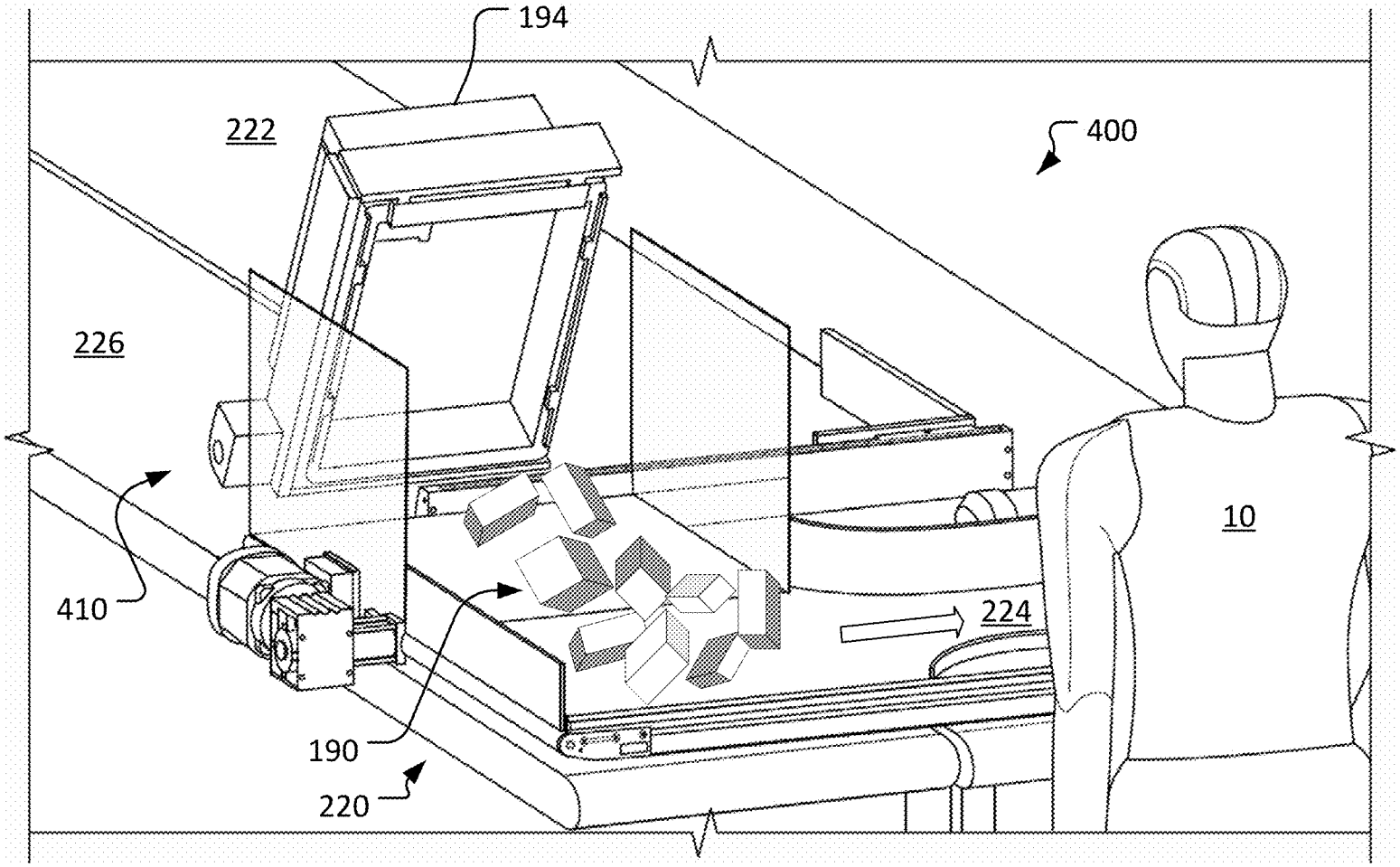
FIG. 4 illustrates a perspective view of an example container handling system that is configured for use at the input of another example order sortation system.

FIG. 4 depicts an example improved item induction process 400. Such improved item induction processes can induct items 190 to the automated item sorter 210 at a faster pace than the manual item induction process as described above.

The item induction process 400 includes a container handling system 410. As depicted, the container handling system 410 inverts or tilts the container 194 so that the items 190 are gently transferred from the container 194 onto the item conveyor system 220. From there, the worker 10 simply manually separates the items 190 from each other so that each item 190 will travel along the induction conveyor 224 one after another. In some embodiments, this separation can be performed by a robot with a vision system or another type of automation, instead of the worker 10.

It can be envisioned that the time it takes the worker 10 to simply separate the items 190 (as per the item induction process 400) is much less than the time it takes the worker 10 to use the manual item induction process described above that requires the worker 10 to reach into the container 194, grasp an individual item 190 within the container 194, and then place the individual item 190 onto the induction conveyor 224. Accordingly, the rate of item induction to the item sorter 210 is much faster using the item induction process 400. Therefore, the throughput of the item sorter 210 using the item induction process 400 is substantially increased.

FIGS. 5-8 are a series of illustrations (top views) that show how the example improved item induction process 400 operates.

Figure 5:
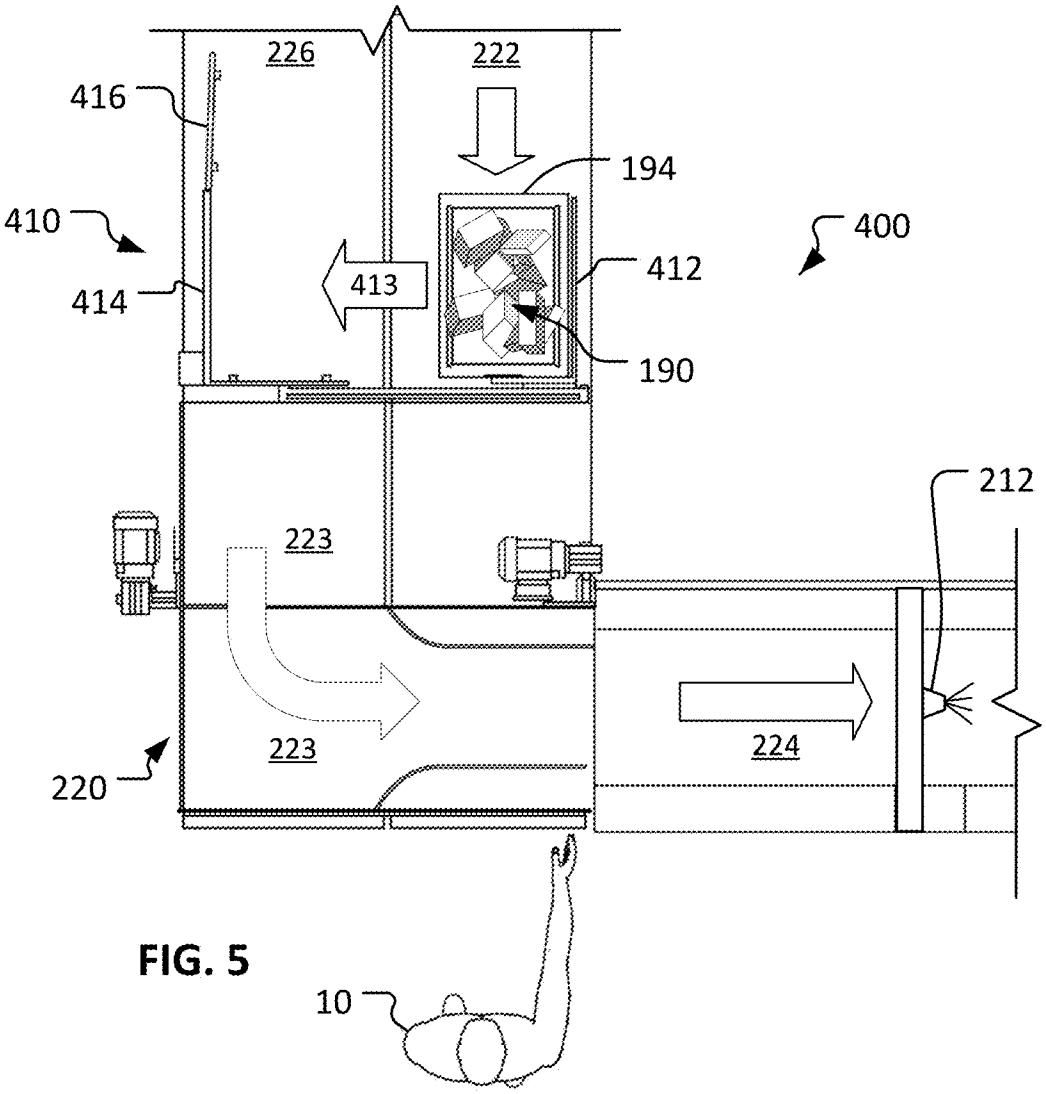
FIG. 5 illustrates a top view of the container handling system of FIG. 4 in a first configuration.

As shown in FIG. 5, an incoming container 194 carrying items 190 for the item sorter 210 (not visible) is transported to the item induction process 400 by the incoming conveyor 222. Here, the container handling system 410 will engage the incoming container 194 and then tilt the container 194, as described further below. In some embodiments, a barcode on the incoming container 194 is scanned.

The items 190 will be transferred from the tilted container 194 onto the conveyor system 220 where the worker 10 will simply separate the items 190, as described further below. The items 190 will be conveyed by the induction conveyor 224, in a separated manner, to the input of the item sorter 210. The individual items 190 will be scanned by the barcode scanner 212 on their way to the item sorter 210 via the induction conveyor 224.

Broadly speaking, the example container handling system 410 includes a pusher 412, a frame member 414, and a clamp 416. The clamp 416 is movably coupled to the frame member 414. The frame member 414 is L-shaped in the depicted embodiment.

It should be understood that the depicted example container handling system 410 is simply one type of mechanism that can be used to engage and tilt the containers 194. Many other types of mechanisms are also envisioned. That is, it should be understood that the depicted container handling system 410 is simply one non-limiting example of a container handling system 410 that can engage and tilt the containers 194.

As indicated by arrow 413, the pusher 412 operates to slide the container 194 into engagement with the frame member 414.

Figure 6:
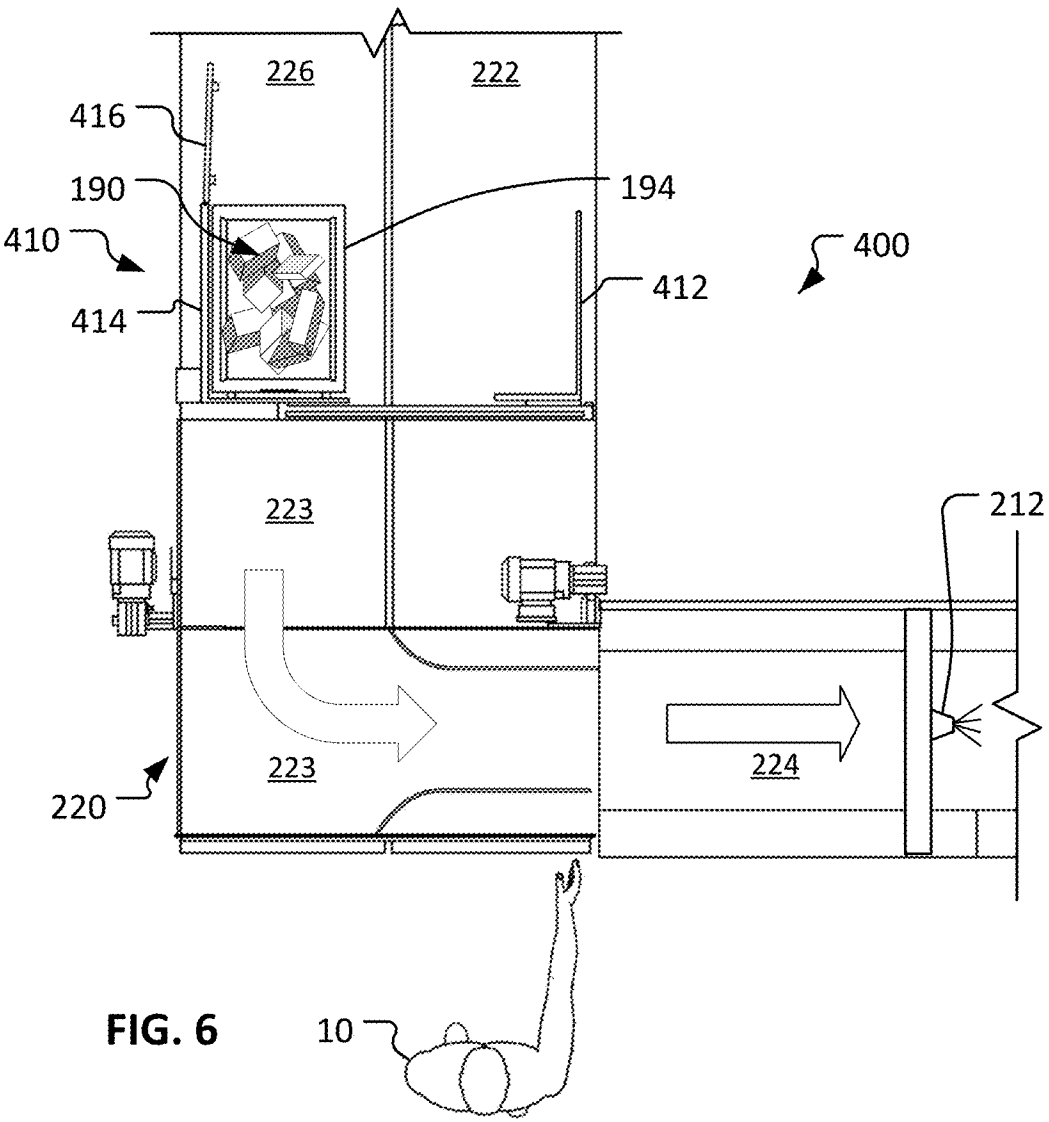
FIG. 6 illustrates a top view of the container handling system of FIG. 4 in a second configuration.

As shown in FIG. 6, the container 194 carrying the items 190 can be moved into engagement with the frame member 414 by the pusher 412. In the depicted embodiment, the pusher 412 has returned to its home position (as shown) after sliding the container 194 to the frame member 414. Alternatively, in some embodiments the pusher 412 can stay in engagement with the container 194 while the container 194 is engaged with the frame member 414. The L-shaped frame member 414 is in contact with the container 194 on two sides of the container 194 in the depicted arrangement.

Figure 7:
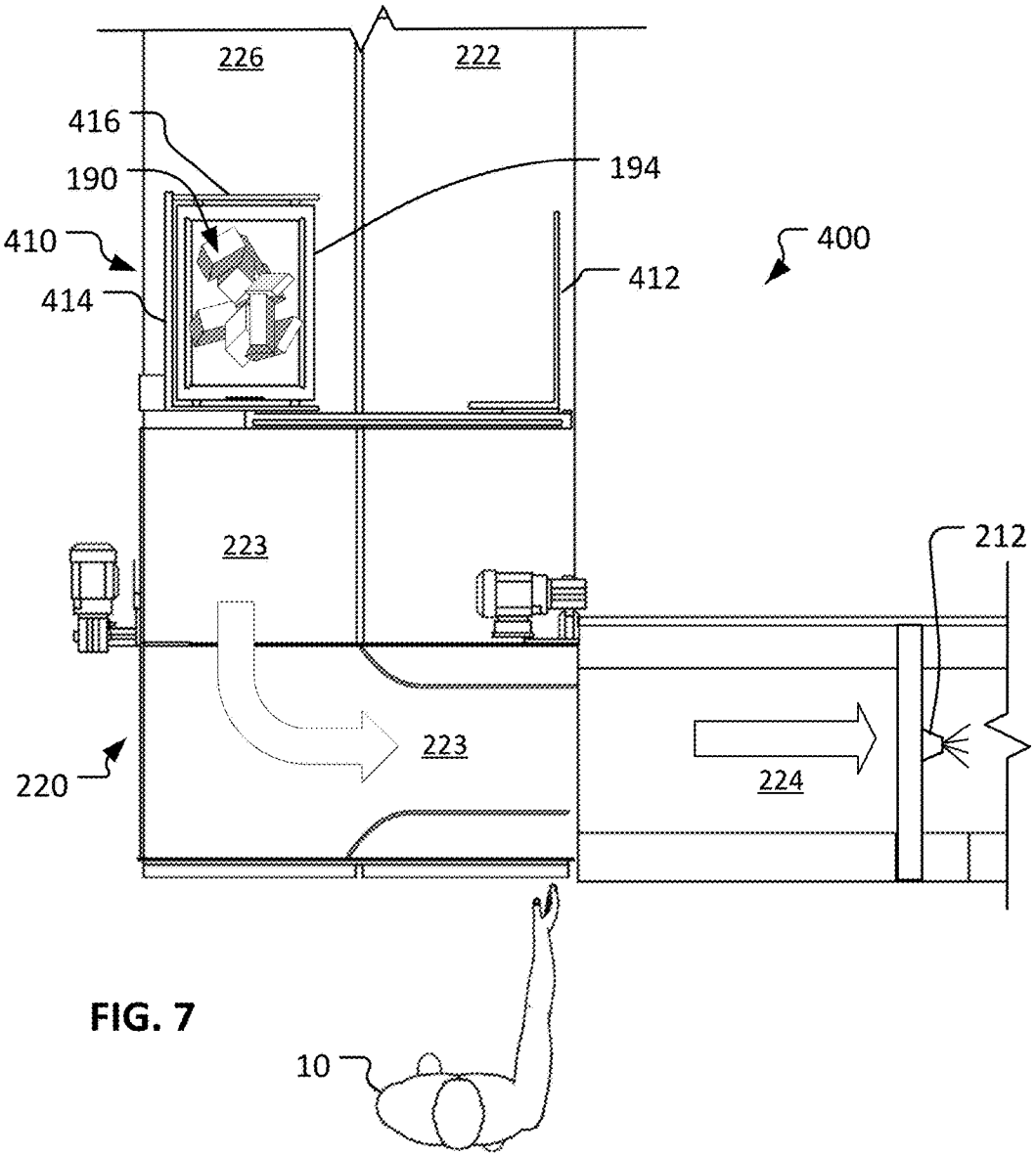
FIG. 7 illustrates a top view of the container handling system of FIG. 4 in a third configuration.

As shown in FIG. 7, while the L-shaped frame member 414 is in contact with the container 194 on two sides of the container 194, the clamp 416 can also move into engagement with the container 194. For example, in the depicted embodiment the clamp 416 pivots into engagement with the container 194. Accordingly, in the illustrated arrangement the container handling system 410 is now engaged with the container 194 on three sides of the container 194. Had the pusher 412 stayed in engagement with the container 194 while the container 194 is engaged with the frame member 414, then the container handling system 410 would be engaged with the container 194 on all four sides of the container 194.

Figure 8:
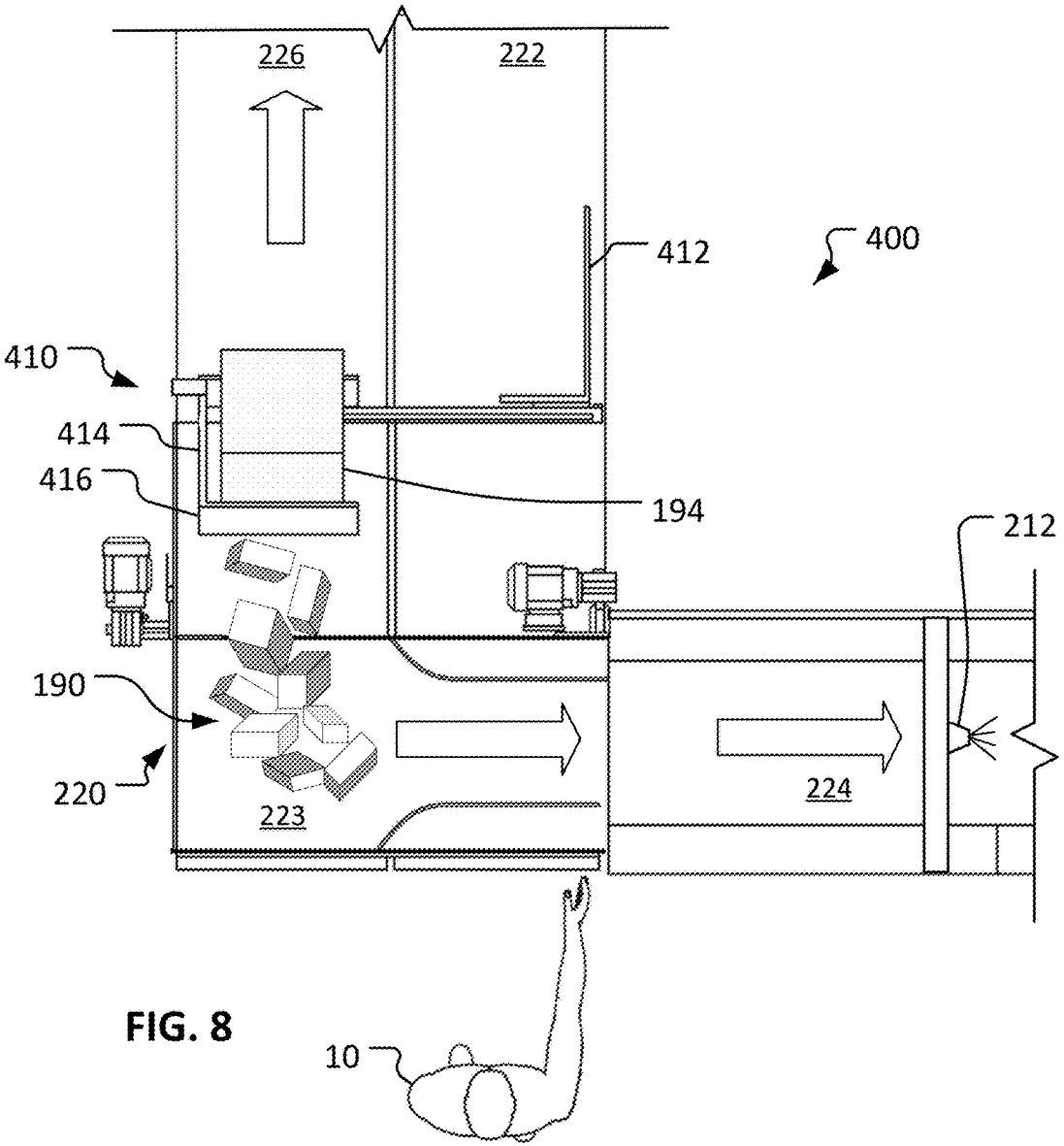
FIG. 8 illustrates a top view of the container handling system of FIG. 4 in a fourth configuration.

As shown in FIG. 8, while the L-shaped frame member 414 and the clamp 416 are in contact with the container 194, the container handling system 410 can tilt/invert the container 194. In result, the items 190 are transferred from the container 194 onto the item conveyor system 220.

In the depicted embodiment the item conveyor system 220 includes a 90 degree corner conveyor portion 223. Accordingly, the 90 degree corner conveyor portion 223 may naturally tend to separate the items 190 to some extent. Then, the worker 10 can separate the items 190 so that the items 190 progress onto the induction conveyor 224 one by one. The barcode scanner 212 will scan each of the items 190 as the items 190 are transported by the induction conveyor 224 to the input of the item sorter 210 (not visible).

After the container 194 has been tilted by the container handling system 410 as depicted, then the container handling system 410 can place the empty container 194 back down onto the outgoing conveyor 226. The outgoing conveyor 226 can then transport the empty container 194 back to the work area where the container 194 can be reused.

Figure 9:
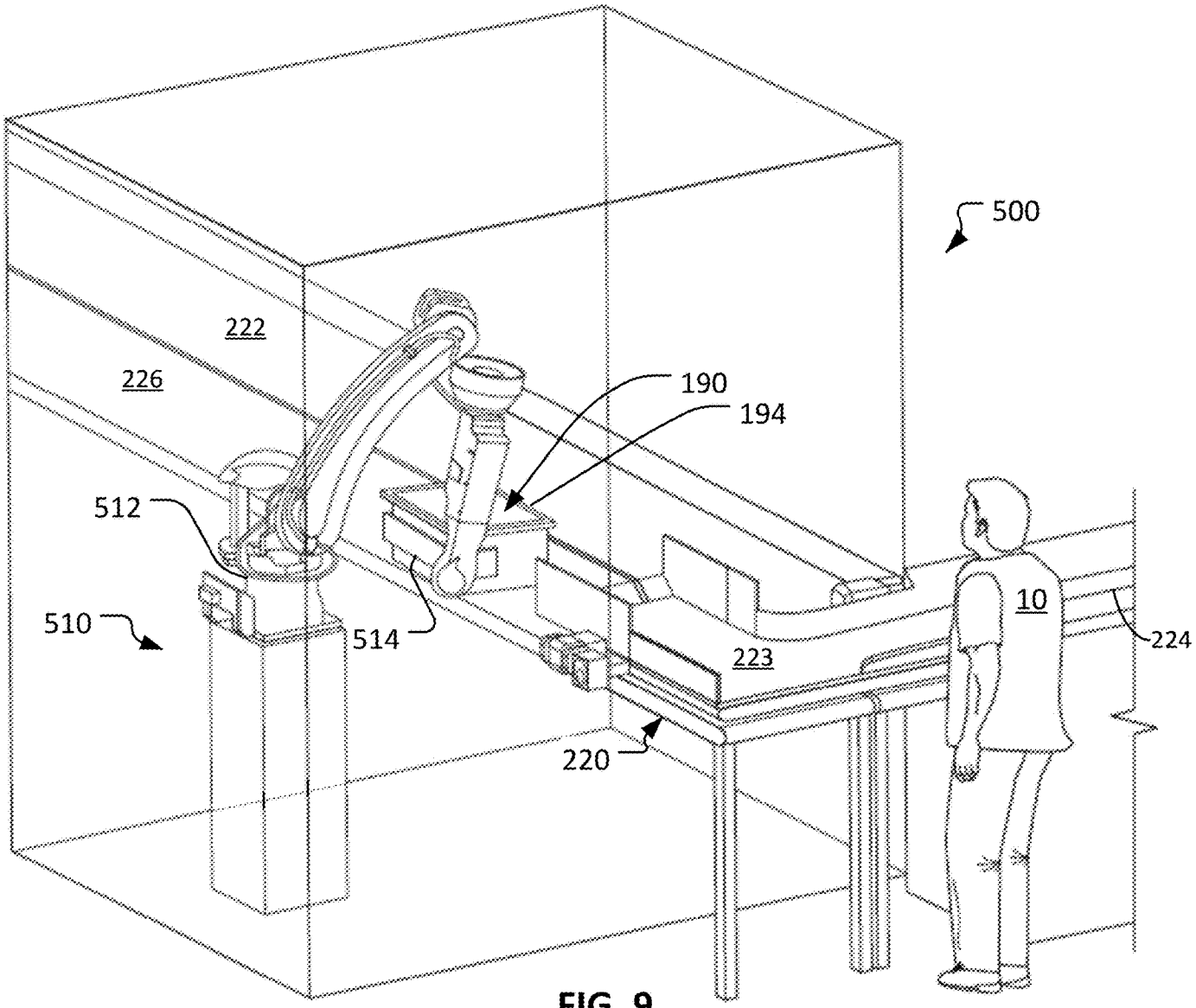
FIG. 9 illustrates a perspective view of another example container handling system that is configured for use in another example order sortation system.

FIG. 9 shows another example item induction process 500. In this example, the container handling system 510 comprises a robotic manipulator 512 with an end effector 514. The end effector 514 is configured to releasably engage the container 194 (no pusher is needed). Then, while the end effector 514 is releasably engaged with the container 194, the robotic manipulator 512 can tilt or invert the container 194 to make the items 190 in the container 194 gently tumble onto the item conveyor system 220 (e.g., onto the 90 degree corner conveyor portion 223). From there, the worker 10 can separate the items 190 so that the items 190 progress onto the induction conveyor 224 one by one. The barcode scanner 212 (not visible) will scan each of the items 190 as the items 190 are transported by the induction conveyor 224 to the input of the item sorter 210 (not visible).

Particular embodiments of the subject matter have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results. In certain implementations, multitasking and parallel processing may be advantageous.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse, a trackball, or a touchscreen, etc.) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, tactile input, eye movement tracking input, a brain-computer interface, gesture input, and the like, and combinations thereof).

While this specification contains many specific implementation details, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described herein as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system modules and components in the embodiments described herein should not be understood as requiring such separation in all embodiments, and it should be understood that the described program components and systems can generally be integrated together in a single product or packaged into multiple products.

What is claimed is:

1. An order sortation system comprising:

an incoming conveyor configured to transport a container holding items to an input of a container handling system;

an automated item sorter configured to separate the items into groups in accordance with orders for the items;

an item conveyor system arranged to transport the items to an input of the automated item sorter;

a barcode scanner positioned along the item conveyor system and configured to obtain scans of barcodes of the items being transported on the item conveyor system; and the container handling system comprising:

a mechanism to invert the container holding the items to transfer the items onto the item conveyor system so that the item conveyor system can transport the items past the barcode scanner and to the input of the automated item sorter; and a pusher mechanism to slide the container holding the items across the incoming conveyor to an outgoing conveyor and into engagement with the mechanism to invert the container holding the items, wherein the outgoing container conveyor is configured to transport the container away from the container handling system after the container has been inverted by the container handling system.

2. The system of claim 1, wherein the mechanism of the container handling system is configured to grasp the container on a total of three sides of the container.

3. The system of claim 1, wherein the mechanism of the container handling system is configured to grasp the container on all four sides of the container.

4. The system of claim 1, wherein the container is a tote.

5. The system of claim 1, wherein the container handling system comprises a robotic manipulator.

6. The system of claim 1, wherein the item conveyor system comprises a 90 degree corner conveyor portion.

7. The system of claim 1, wherein the mechanism of the container handling system includes an arm that pivots to clamp the container against one or more other clamping surfaces of the mechanism.

8. The system of claim 1, wherein the mechanism of the container handling system comprises a clamp mechanism configured to move into engagement with the container.

9. The system of claim 8, wherein the clamp mechanism is configured to pivot into engagement with the container.

10. A method of sorting items, the method comprising:

transporting, on an incoming container conveyor, a container holding items to a container handling system;

sliding, by the container handling system, the container holding the items across the incoming container conveyor and onto an outgoing container conveyor;

inverting, by the container handling system, the container holding the items to transfer the items onto an item conveyor system;

transporting, on the outgoing container conveyor, the container away from the container handling system after the container has been inverted by the container handling system;

transporting, by the item conveyor system, the items to an input of an automated item sorter; and sorting, by the automated item sorter, the items into groups in accordance with orders for the items.

11. The method of claim 10, further comprising obtaining, by a barcode scanner positioned along the item conveyor system, scans of barcodes of the items being transported on the item conveyor system.

12. The method of claim 10, further comprising grasping, by the container handling system, the container holding the items prior to inverting the container.

13. The method of claim 12, wherein the grasping comprises clamping the container on a total of three sides of the container.

14. The method of claim 12, wherein the grasping comprises clamping the container on all four sides of the container.

15. The method of claim 10, wherein the transporting the items to the input of the automated item sorter includes transporting the items along a 90 degree turn in the item conveyor system.

16. The method of claim 10, further comprising, separating the items on the item conveyor system after the container has been inverted by the container handling system.

17. The method of claim 16, wherein the separating is performed by a human worker.

18. The method of claim 10, further comprising clamping, using a clamping mechanism, the container holding the items after the container holding the items has been slid across the incoming container conveyor and onto the outgoing container conveyor.

19. The method of claim 18, wherein the clamping mechanism is configured to pivot into engagement with the container.

20. The method of claim 19, wherein the clamping mechanism is in engagement with the containing during the inverting of the container holding the items.

* * * * *